US011421955B1

(12) United States Patent
Matheson

(10) Patent No.: US 11,421,955 B1
(45) Date of Patent: Aug. 23, 2022

(54) TRIGGER PULL COVER

(71) Applicant: Scott Matheson, Plymouth, WI (US)

(72) Inventor: Scott Matheson, Plymouth, WI (US)

( * ) Notice: Subject to any disclaimer, the term of this patent is extended or adjusted under 35 U.S.C. 154(b) by 0 days.

(21) Appl. No.: 17/572,804

(22) Filed: Jan. 11, 2022

Related U.S. Application Data

(60) Provisional application No. 63/142,639, filed on Jan. 28, 2021.

(51) Int. Cl.
*F41A 19/10* (2006.01)
*F41B 5/14* (2006.01)

(52) U.S. Cl.
CPC ..... *F41A 19/10* (2013.01); *F41B 5/1469* (2013.01)

(58) Field of Classification Search
CPC ..... F41A 19/10; F41B 5/1469
See application file for complete search history.

(56) References Cited

U.S. PATENT DOCUMENTS 1,521,286 A * 12/1924 Fisher ..... F41A 19/10 42/106
3,879,877 A * 4/1975 Cizeron ..... F41A 19/21 42/42.01
5,435,092 A * 7/1995 Brodie ..... F41A 35/00 42/104
5,503,137 A * 4/1996 Fusco ..... F41B 11/62 124/56
6,189,525 B1 * 2/2001 Kutrubes ..... F41A 19/10 124/31
6,298,594 B1 * 10/2001 Strayer ..... F41A 19/10 D22/108
6,651,642 B1 * 11/2003 Powers ..... F41B 5/1469 124/31
6,957,644 B2 * 10/2005 Simo ..... F41B 5/1469 124/31
7,987,624 B1 * 8/2011 Moller ..... F41A 21/30 42/76.01
7,992,338 B2 * 8/2011 Bowman ..... F41A 19/10 42/90
9,052,149 B2 * 6/2015 Bender ..... F41A 19/00
9,239,202 B2 * 1/2016 Michal ..... F41A 21/44
10,775,122 B1 * 9/2020 Rofkahr, Jr. ..... F41A 19/11
11,248,869 B2 * 2/2022 Lopata ..... F41A 19/10
(Continued)

OTHER PUBLICATIONS

"Trigger Guard Cover", https://www.cooksholsters.com/trigger-guard-cover/ (Year: 2020).*

*Primary Examiner* — Joshua T Semick
(74) *Attorney, Agent, or Firm* — Donald J. Ersler

(57) ABSTRACT

A release trigger pull cover preferably includes a slip-on trigger tube and a compressible section. An inner perimeter of the slip-on trigger tube is sized to receive a trigger of a string release. The compressible section preferably includes a trigger portion and at least two flexible supports. One end of the at least two flexible projections extend from a back-side of the trigger portion. An opposing end of the at least two flexible projections are engaged with a front of the slip-on trigger tube. A firearm trigger pull cover preferably includes a slip-on trigger tube and front pad. An inner perimeter of the slip-on trigger tube is sized to receive a trigger of a firearm. A front area of the front pad includes a widthwise flat surface and a plurality of vertical ridges. An alternative embodiment of the firearm trigger pull cover includes a trigger tube and cantilever pull.

18 Claims, 5 Drawing Sheets

(56) References Cited

U.S. PATENT DOCUMENTS

| | | | | |
|---|---|---|---|---|
| 2012/0117841 | A1* | 5/2012 | Joubert | F41A 19/16<br>42/69.01 |
| 2013/0104435 | A1* | 5/2013 | Fuller | F41A 19/10<br>42/69.01 |

* cited by examiner

TRIGGER PULL COVER

BACKGROUND OF THE INVENTION

Cross-References to Related Applications

This is a non-provisional application, which claims the benefit of provisional patent application no. 63/142,639, filed on Jan. 28, 2021.

Field of the Invention

The present invention relates generally to projectile firing devices and more specifically to a trigger pull cover, which insulates a user to provide a smoother, more consistent projectile firing.

Discussion of the Prior Art

Trigger mechanisms are used in string releases and firearms. The process of pulling the trigger is critical in the aim of the projectile being fired from a bow, crossbow or a firearm. However, trigger mechanisms in crossbows are similar to trigger mechanisms in firearms. String releases include triggers that do not require a high amount of pull force to release the bowstring. It would be advantageous to have a device, which allows the archer to feel the position of the trigger without pulling the trigger and releasing the bowstring during the process of feeling for the position of the trigger. Concerning firearms, it is advantageous to insulate a shooter from feeling a rough sear mechanism or a vibration generated by pulling the trigger. It is common for shooters to have the sear surfaces of their firearms polished to eliminate a roughness or grittiness due to machining sear surfaces during manufacture. Insulating the shooter from feeling any roughness in the trigger mechanism will provide a more fluid trigger pull, which produces a more accurate shot. A string release does not have a defined force to let the shooter know when the trigger is going to release the string. Consequently, the trigger pull cover will provide a more fluid trigger pull, while minimizing target panic or slap shots to produce a more accurate shot.

Accordingly, there is a clearly felt need in the art for a trigger pull cover, which is slipped over the trigger of a bow or firearm; insulates a user from feeling a rough sear mechanism; allows an archer to feel a position of a trigger without accidentally releasing a bow string; and provides a more fluid trigger pull, while minimizing target panic or slap shots to produce a more accurate shot.

SUMMARY OF THE INVENTION

The present invention provides a trigger pull cover, which allows an archer to feel a position of a trigger without accidentally releasing a bow string. A release trigger pull cover preferably includes a slip-on trigger tube and a compressible section. The slip-on trigger tube preferably has the shape of a tubular arc. An inner perimeter of the slip-on trigger tube is sized to receive a trigger of a string release. The compressible section preferably includes a trigger portion and at least two flexible supports. The trigger portion includes a curved profile. A location projection preferably extends from a front of the trigger portion. One end of the at least two flexible projections extend from a backside of the trigger portion. An opposing end of the at least two flexible projections are engaged with a front of the slip-on trigger tube. It is preferably that the release trigger pull cover be molded as a single unit. It is preferable that the release trigger pull cover be fabricated from a silicone or any other suitable elastic material. It is preferable that the silicone have a durometer of 50-65 for a light touch or a durometer of 80-90 for a medium touch. However, other durometers could also be used.

A firearm trigger pull cover preferably includes a slip-on trigger tube and a front pad. The slip-on trigger tube preferably has the shape of a tubular arc. An inner perimeter of the slip-on trigger tube is sized to receive a trigger of a firearm. It is preferable to chamfer a bottom of the slip-on trigger tube to provide clearance for the trigger guard. The front pad extends from a front of the slip-on trigger tube. A front area of the front pad includes a flat surface and a plurality of vertical ridges extending from a front of the flat surface. The flat surface is preferably as wide as a width of the slip-on trigger tube. It is preferably that the firearm trigger pull cover be molded as a single unit. It is preferable that the release trigger pull cover be fabricated from a silicone or any other suitable elastic material. It is preferable that the silicone have a durometer of between 25-50. However, other durometers could also be used. The silicone material will store energy while being compressed by a finger. The stored energy will reduce the amount of force required to bring the trigger to a sear release.

An alternative embodiment of a firearm trigger pull cover preferably includes a slip-on trigger tube and a cantilever pull. The cantilever pull is preferably joined to a top of the slip-on trigger tube with an inverted U-shape projection. The slip-on trigger tube preferably has the shape of a tubular arc. An inner perimeter of the slip-on trigger tube is sized to receive a trigger of a firearm. It is preferable to chamfer a bottom of the slip-on trigger tube to provide clearance for a trigger guard of the firearm. A horizontal location projection preferably extends from a front of the cantilever pull. The cantilever pull is preferably as wide as a width of the slip-on trigger tube. It is preferable that the slip-on trigger tube. The inverted U-shaped projection and a cantilever pull be molded as a single unit. It is preferable that the release trigger pull cover be fabricated from a silicone or any other suitable elastic material. It is preferable that the silicone have a durometer of between 25-50. However, other durometers could also be used. The silicone material will store energy while being compressed by a finger. The stored energy will reduce the amount of force required to bring the trigger to a sear release.

Accordingly, it is an object of the present invention to provide a trigger pull cover, which is slipped over the trigger of a bow or firearm.

It is an additional object of the present invention to provide a trigger pull cover, which insulates a user from feeling a rough sear mechanism or vibration from a trigger mechanism.

It is another object of the present invention to provide a trigger pull cover, which allows an archer to feel a position of a trigger without accidentally releasing a bow string.

Finally, it is another object of the present invention to provide a trigger pull cover, which provides a more fluid trigger pull, while minimizing target panic or slap shots to produce a more accurate shot.

These and additional objects, advantages, features and benefits of the present invention will become apparent from the following specification.

DETAILED DESCRIPTION OF THE PREFERRED EMBODIMENTS

Figure 1:
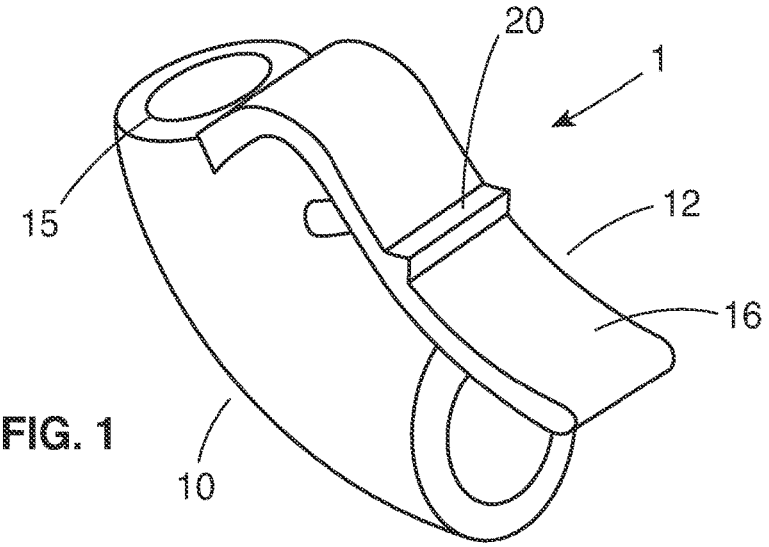
FIG. 1 is a perspective view of a release trigger pull cover in accordance with the present invention.
Figure 2:
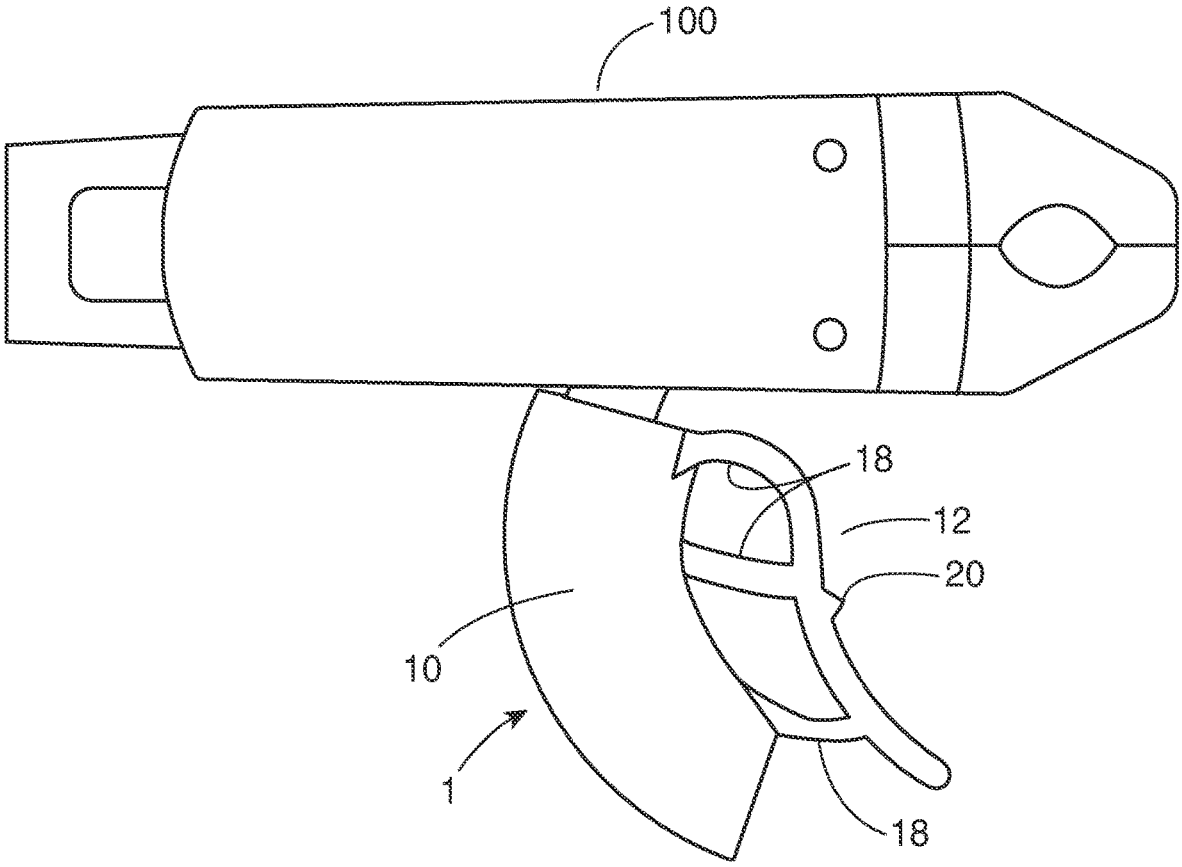
FIG. 2 is a side view of a release trigger pull cover retained on a trigger of a string release in accordance with the present invention.
Figure 3:
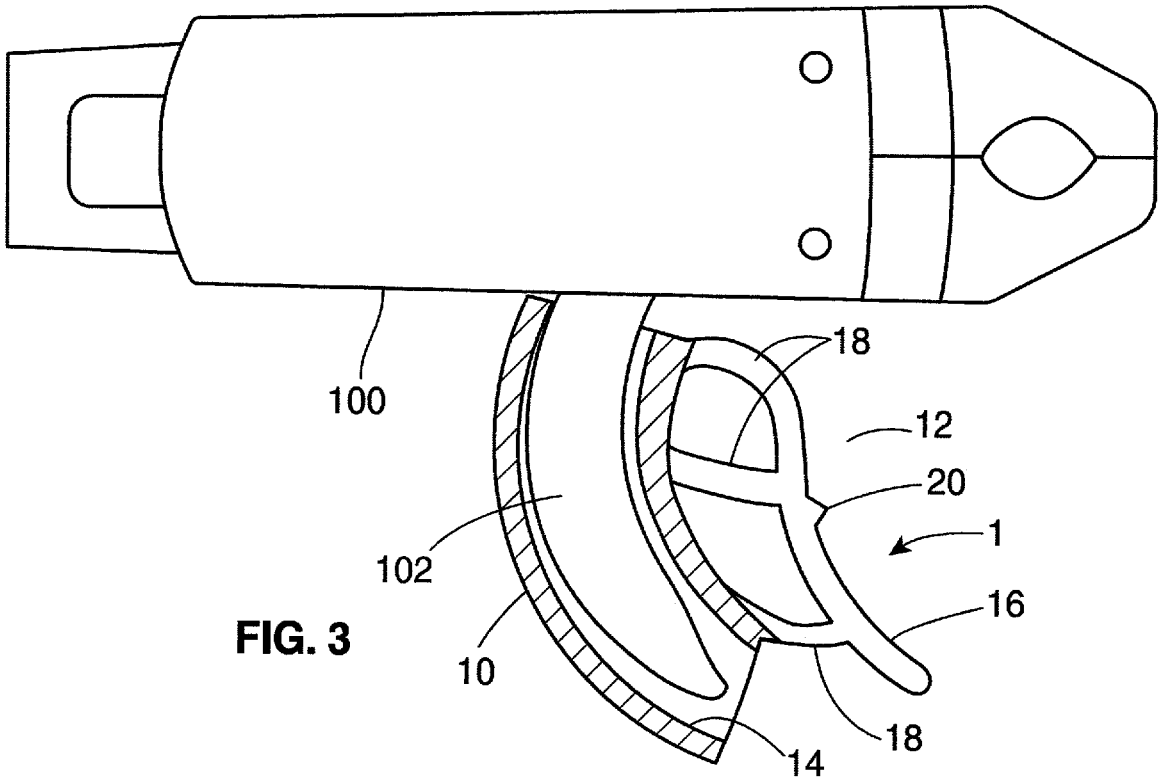
FIG. 3 is a side cross sectional view of a release trigger pull cover retained on a trigger of a string release in accordance with the present invention.
Figure 4:
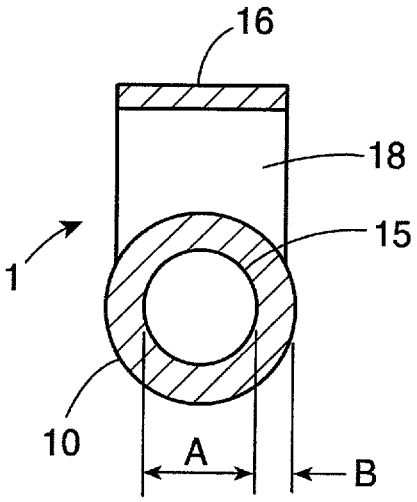
FIG. 4 is a cross sectional view of a release trigger pull cover in accordance with the present invention.
Figure 5:
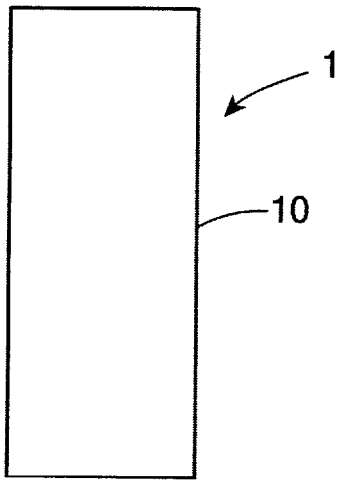
FIG. 5 is a rear view of a release trigger pull cover in accordance with the present invention.
Figure 6:
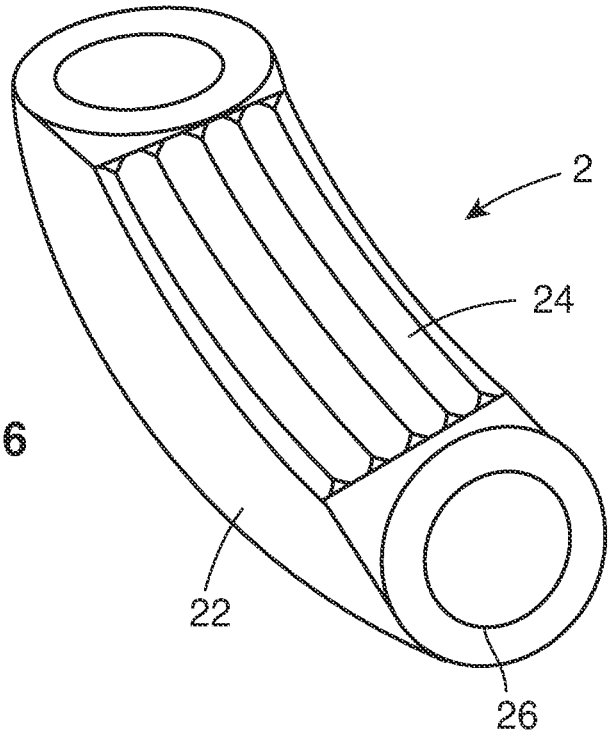
FIG. 6 is a perspective view of a firearm trigger pull cover in accordance with the present invention.
Figure 7:
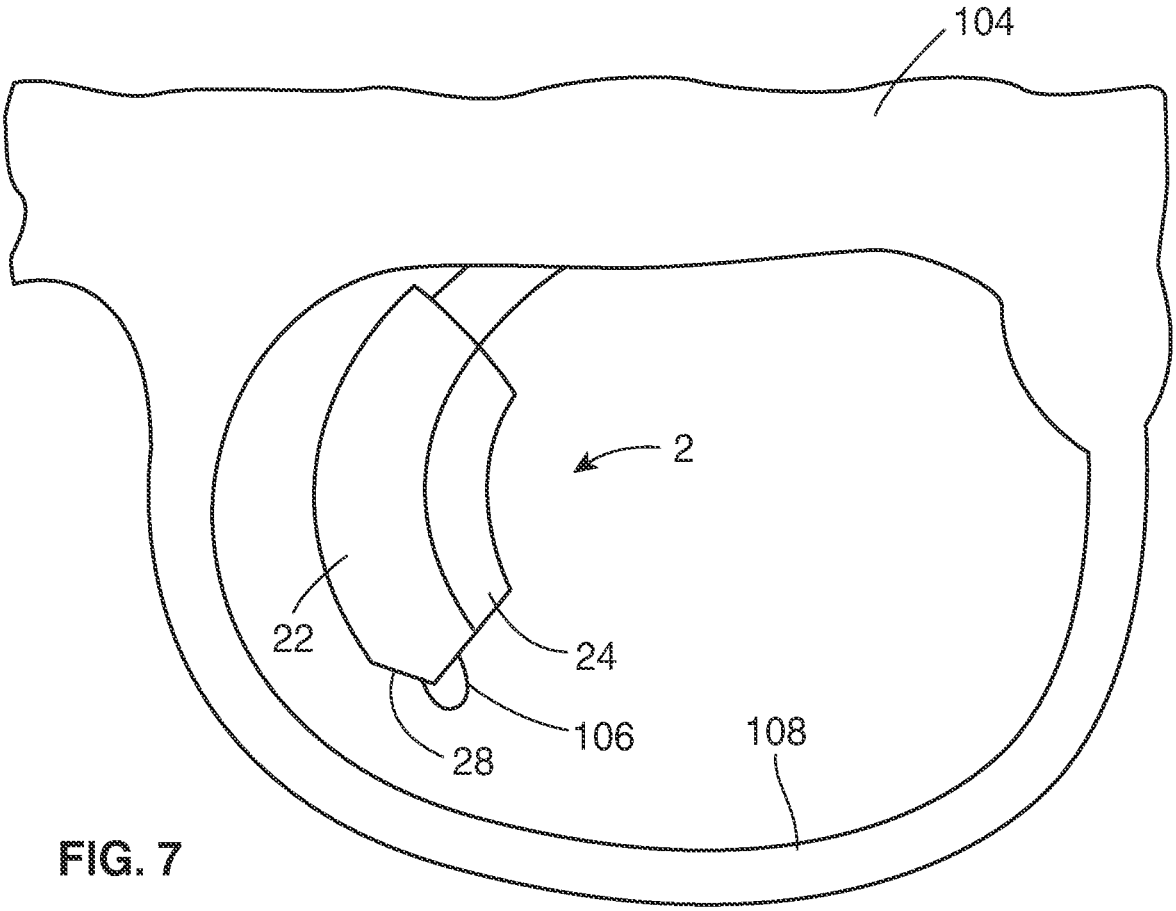
FIG. 7 is a side view of a firearm trigger pull cover retained on a trigger of a firearm in accordance with the present invention.
Figure 8:
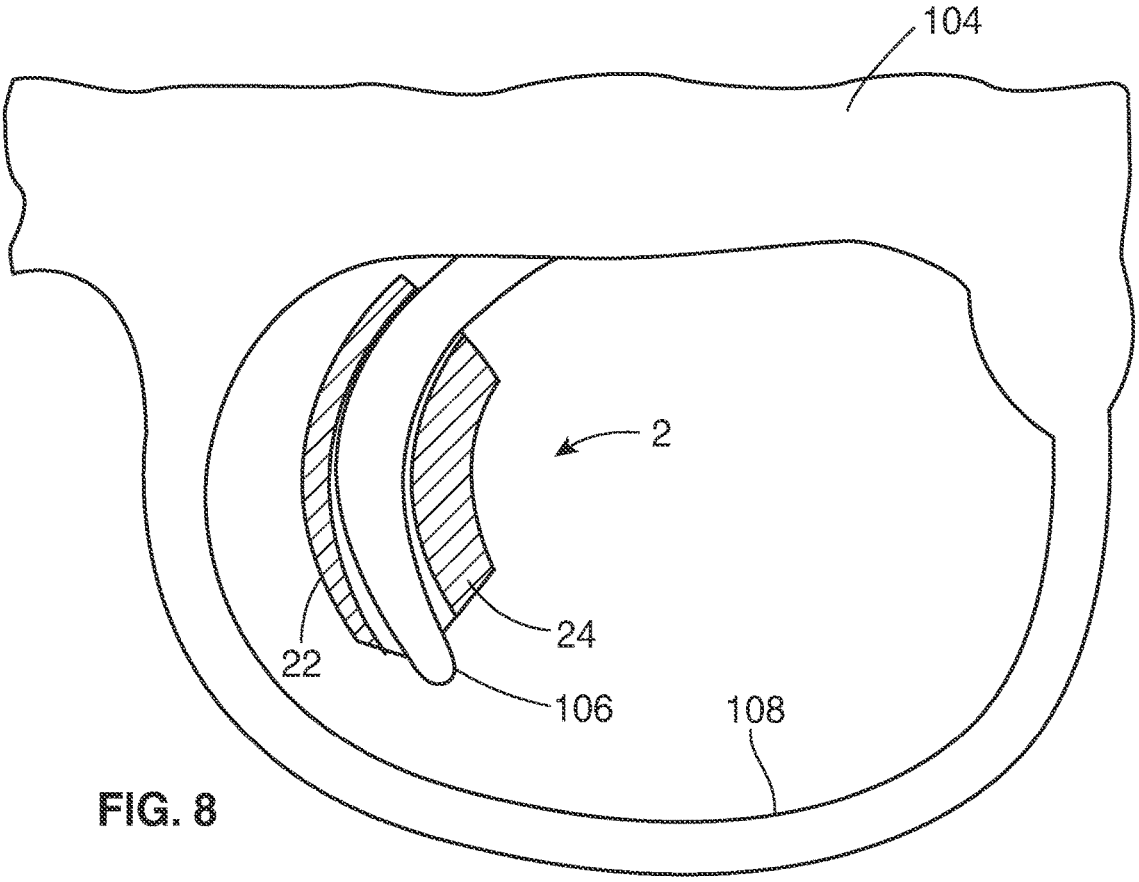
FIG. 8 is a side cross sectional view of a firearm trigger pull cover retained on a trigger of a firearm in accordance with the present invention.
Figure 9:
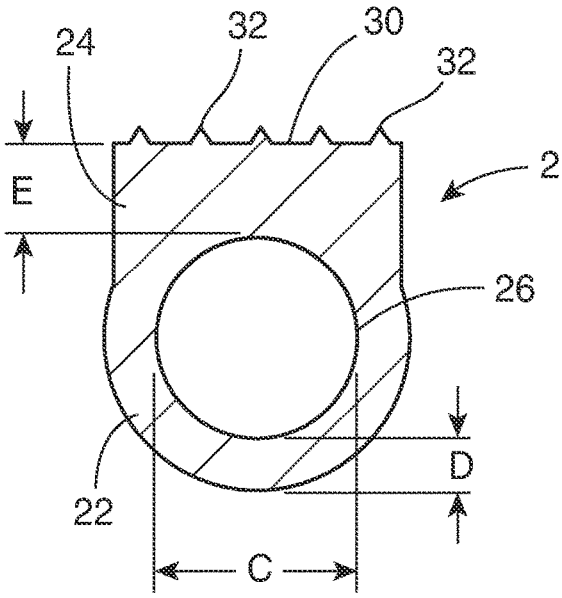
FIG. 9 is a cross sectional view of a firearm trigger pull cover in accordance with the present invention.
Figure 10:
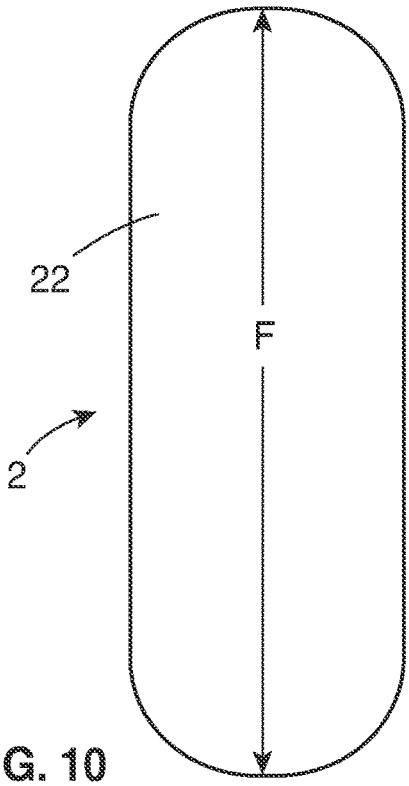
FIG. 10 is a rear view of a firearm trigger pull cover in accordance with the present invention.

With reference now to the drawings, and particularly to FIG. 1, there is shown a perspective view of a release trigger pull cover 1. With reference to FIGS. 2-5, the release trigger pull cover 1 preferably includes a slip-on trigger tube 10 and a compressible section 12. The slip-on trigger tube 10 preferably has the shape of a tubular arc. An inner perimeter 15 of the slip-on trigger tube 10 is sized to receive a trigger 102 of a string release 100. However, the slip-on trigger tube 10 could be straight, but assumes a curved shape when a trigger 102 is inserted into the inner perimeter 15 thereof. The compressible section 12 preferably includes a trigger portion 16 and at least two flexible supports 18. The trigger portion 16 includes a widthwise flat surface and a curved profile. A horizontally oriented location projection 20 preferably extends from a front of the trigger portion 16 at substantially a middle of a length thereof. One end of the at least two flexible supports 18 extend from a backside of the trigger portion 16. An opposing end of the at least two projections 18 are engaged with a front of the slip-on trigger tube 10. It is preferable that the release trigger pull cover 1 be molded as a single piece. It is preferable that the release trigger pull cover 1 be fabricated from a silicone or any other suitable elastic material. It is preferable that the silicone have a durometer of 50-65 for a light touch or a durometer of 80-90 for a medium touch. However, other durometers could also be used. The following dimensions are given by way of example and not by way of limitation. The inner perimeter 15 has a preferable width dimension "A" of 0.20-0.32 inches. A wall thickness "B" of the slip-on trigger tube 10 has a preferable range of 0.040-0.070 inches. However, other dimension could also be used.

With reference to FIGS. 6-10, a firearm trigger pull cover 2 preferably includes a slip-on trigger tube 22 and a front pad 24. The slip-on trigger tube 22 preferably has the shape of a tubular arc. An inner perimeter 26 of the slip-on trigger tube 22 is sized to receive a trigger 106 of a firearm 104. However, the slip-on trigger tube 122 could be straight, but assumes a curved shape when a trigger 106 is inserted into the inner perimeter 26 thereof. It is preferable to form a chamfer 28 on a bottom of the slip-on trigger tube 22 to provide clearance for a trigger guard 108. The front pad 24 extends from a front of the slip-on trigger tube 22. A front area of the front pad 24 includes a widthwise flat surface 30 and a plurality of vertical ridges 32 extending from a front of the widthwise flat surface 30. The widthwise flat surface 30 is preferably as wide as a width of the slip-on trigger tube 22. It is preferably that the firearm trigger pull cover 2 be molded as a single unit. It is preferable that the release trigger pull cover be fabricated from a silicone or any other suitable elastic material. It is preferable that the silicone have a durometer of 25-50. However, other durometers could also be used. The silicone material will store energy while being compressed by a finger. The stored energy will reduce the amount of force required to bring the trigger to a sear release for both the release trigger pull cover 1 and the firearm trigger pull cover 2. The following dimensions are given by way of example and not by way of limitation. The inner perimeter 26 has a preferable width dimension "C" of 0.20-0.32 inches. A wall thickness "D" of the slip-on trigger tube 22 has a preferable range of 0.040-0.070 inches. A thickness "E" from the inner perimeter 26 to the widthwise flat surface 30 has a preferable range of 0.12-0.14 inches. A length "F" of the slip-on trigger tube 22 has a preferable range of 0.80-1.1. However, other dimension could also be used.

Figure 11:
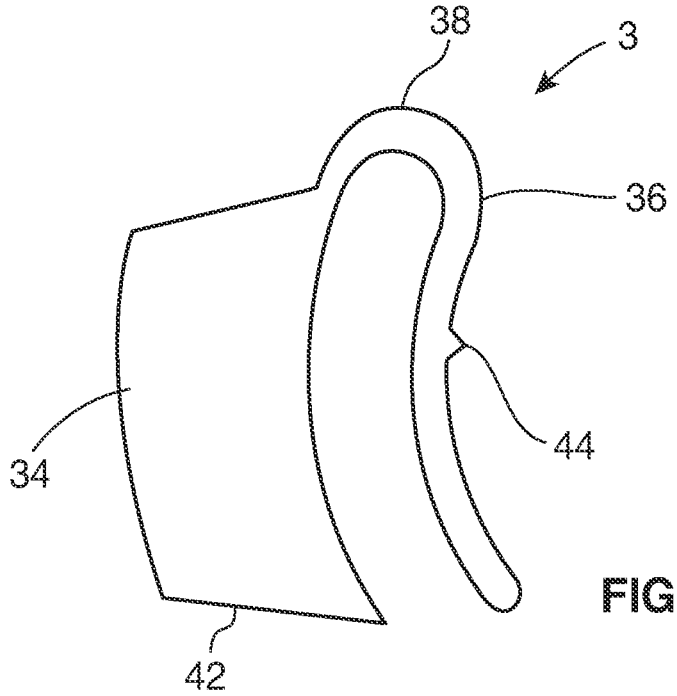
FIG. 11 is a side view of an alternative embodiment of a firearm trigger pull cover in accordance with the present invention.
Figure 12:
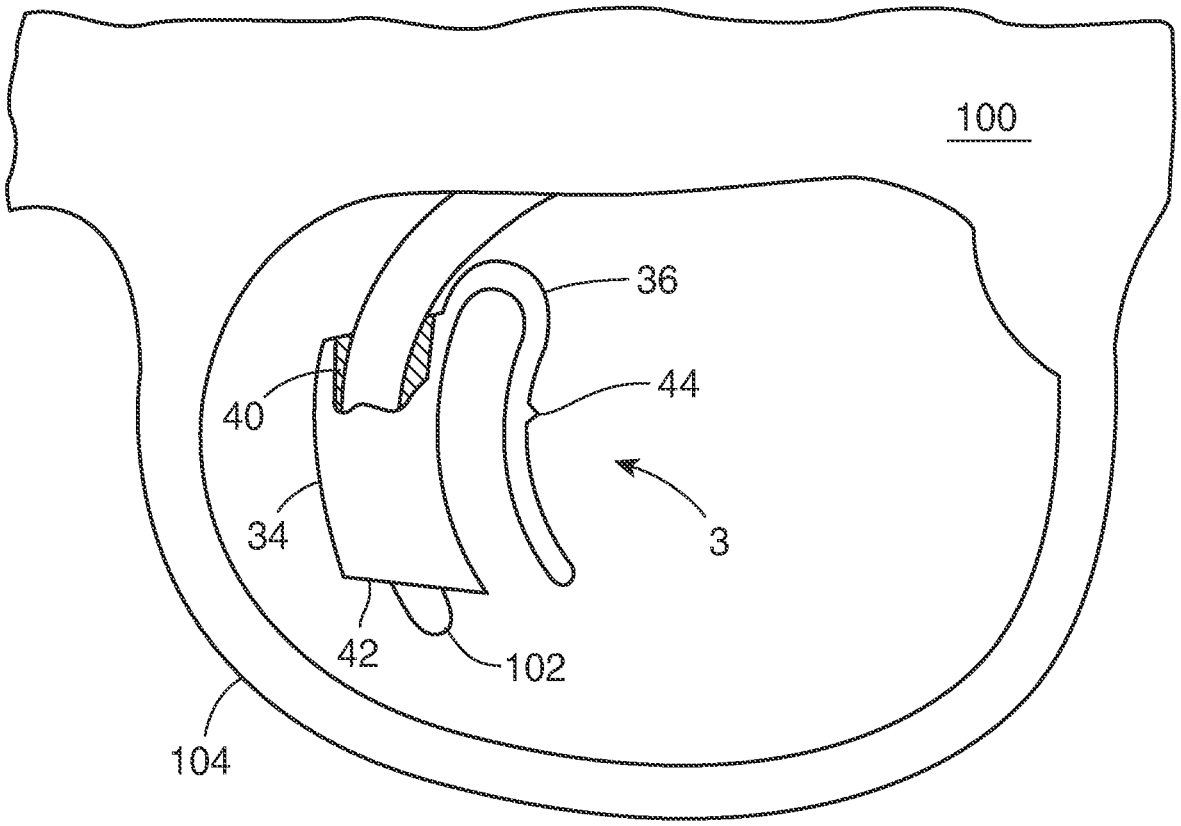
FIG. 12 is a side view of an alternative embodiment of a firearm trigger pull cover retained on a trigger of a firearm in accordance with the present invention.

With reference to FIGS. 11-12, an alternative embodiment of a firearm trigger pull cover 3 preferably includes a slip-on trigger tube 34 and a cantilever pull 36. The cantilever pull 36 is preferably joined to a top of the slip-on trigger tube 34 with an inverted U-shaped projection 38. The slip-on trigger tube 34 preferably has the shape of a tubular arc. An inner perimeter 40 of the slip-on trigger tube 34 is sized to receive a trigger 102 of a firearm 100. It is preferable to chamfer a bottom 42 of the slip-on trigger tube 34 to provide clearance for a trigger guard 104. A horizontal location projection 44 preferably extends from a front of the cantilever pull 36 at a middle thereof and cross a width of the cantilever pull 36, similar to horizontally oriented location projection 20. The cantilever pull 36 includes a curved profile which matches a curved profile of a front of the slip-on trigger tube 34 and the trigger 102 itself. The cantilever pull 36 is preferably as wide as a width of the slip-on trigger tube 34. It is preferable that the slip-on trigger tube 34, U-shaped projection 38 and the cantilever pull 36 be molded as a single unit. It is preferable that the release trigger pull cover 3 be fabricated from a silicone or any other suitable elastic material. It is preferable that the silicone have a durometer of between 25-50. However, other durometers could also be used. The silicone material will store energy while being compressed by a finger. The stored energy will reduce the amount of force required to bring the trigger to a sear release.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A trigger pull cover for a projectile firing device, comprising:

a slip-on trigger tube including an inner perimeter which is sized to receive a trigger of the projectile firing device, said inner perimeter has a shape of a tubular arc;

a U-shaped projection having a first end extending from a top of said slip-on trigger tube; and a cantilever pull extending downward from a second end of said U-shaped projection, said slip-on trigger tube is fabricated from an elastic material.

2. The trigger pull cover for a projectile firing device of claim 1, further comprising:

a horizontal location projection formed on a front of said cantilever pull at a middle thereof.

3. The trigger pull cover for a projectile firing device of claim 1 wherein:

a bottom of said slip-on trigger tube is chamfered.

4. The trigger pull cover for a projectile firing device of claim 1 wherein:

said elastic material is silicone.

5. The trigger pull cover for a projectile firing device of claim 1 wherein:

a durometer measurement of said elastic material has a range of one of 25-50, 50-65 and 80-90.

6. A trigger pull cover for a string release, comprising:

a slip-on trigger tube including an inner perimeter which is sized to receive a trigger of a string release; and a compressible section includes a trigger portion and at least two flexible supports, said trigger portion includes a curved profile, one end of said at least two flexible supports extend from a backside of said trigger portion, an opposing end of said at least two projections are engaged with a front of said slip-on trigger tube.

7. The trigger pull cover for a string release of claim 6 wherein:

said slip-on cover and said compressible section are fabricated from a single piece of material.

8. The trigger pull cover for a string release of claim 6 wherein:

said slip-on trigger tube is fabricated from an elastic material.

9. The trigger pull cover for a string release of claim 8 wherein:

said elastic material is silicone.

10. The trigger pull cover for a string release of claim 6 wherein:

a durometer measurement of said elastic material has a range of one of 50-65 or 80-90.

11. The trigger pull cover for a string release of claim 6 wherein:

a horizontally oriented location projection extends from a front of said trigger portion at a middle of a length thereof.

12. The trigger pull cover for a string release of claim 6 wherein:

said trigger portion includes a widthwise flat surface.

13. A trigger pull cover for a firearm or crossbow, comprising:

a slip-on trigger tube including an inner perimeter which is sized to receive a trigger of a projectile firing device, said inner perimeter has a shape of a tubular arc, a substantially round cross section of said inner perimeter is perpendicular to a longitudinal axis of said inner perimeter; and a front pad extends from a front of said slip-on trigger tube, a front area of said front pad includes a widthwise flat surface, said slip-on trigger tube and said front pad are fabricated from an elastic material.

14. The trigger pull cover for a firearm or crossbow of claim 13 wherein:

a plurality of vertical ridges extend from a front of said widthwise flat surface.

15. The trigger pull cover for a firearm or crossbow of claim 13 wherein:

said widthwise flat surface is as wide as a width of said slip-on trigger tube.

16. The trigger pull cover for a firearm or crossbow of claim 13 wherein:

said slip-on trigger tube and said front pad are fabricated from a single piece of material.

17. The trigger pull cover for a firearm or crossbow of claim 13 wherein:

said elastic material is silicone.

18. The trigger pull cover for a firearm or crossbow of claim 17 wherein:

a durometer measurement of said elastic material has a range of one of 25-50.

* * * * *